US006528727B2

(12) United States Patent
Miyazaki

(10) Patent No.: US 6,528,727 B2
(45) Date of Patent: Mar. 4, 2003

(54) SHIELD CONNECTOR

(75) Inventor: Sho Miyazaki, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/839,145

(22) Filed: Apr. 23, 2001

(65) Prior Publication Data

US 2001/0047877 A1 Dec. 6, 2001

(30) Foreign Application Priority Data

Jun. 1, 2000 (JP) ..... 2000-164113

(51) Int. Cl.[7] ..... H01R 13/568
(52) U.S. Cl. ..... 174/84 R; 174/88 C; 439/610
(58) Field of Search ..... 174/75 C, 78, 174/88 C, 84 R; 439/98, 99, 579, 610

(56) References Cited

U.S. PATENT DOCUMENTS 1,397,040 A * 11/1921 Dillon ..... 16/108
2,013,217 A * 9/1935 Olmstead ..... 174/84 C
2,777,894 A * 1/1957 Arbeiter et al. ..... 174/75 C
2,941,028 A * 6/1960 Edlen et al. ..... 174/75 C
3,828,298 A 8/1974 Schumacher
5,127,843 A * 7/1992 Henry et al. ..... 439/320
5,965,847 A 10/1999 Tanaka et al.

FOREIGN PATENT DOCUMENTS

EP 0 977 312 A2 2/2000

* cited by examiner

*Primary Examiner*—Chau N. Nguyen
(74) *Attorney, Agent, or Firm*—Oliff & Berridge, PLC

(57) ABSTRACT

An underlying member 40 provided in a shield connector is fixed to a shielded wire 20 by caulking a first barrel portion 41 thereof, and fixed to a small diametered portion 31 of a rubber plug 30 by caulking a second barrel portion 42 thereof. Because the rubber plug 30 is thus fixed to the underlying member 40, the rubber plug 30 is made immovable with respect to the shielded wire 20 and will not drop out from an electric wire insertion inlet 18. With this structure, the rubber plug holder required in the related-art structure is unnecessary. Thus, the number of the components can be reduced and the assembling workability is improved.

5 Claims, 4 Drawing Sheets

SHIELD CONNECTOR

BACKGROUND OF THE INVENTION

1. Field of the Invention

The present invention relates to a shield connector including a connector housing in which a wire insertion inlet is closed by a rubber plug.

2. Description of the Related Art

As one example of the shield connectors of this type, there has been known a shield connector as disclosed in Japanese Patent unexamined Publication No. JP-A-Hei.10-144403. As shown in FIG. 5, this shield connector includes a cylindrical shield shell 2 inside a connector housing 1, and an end portion of a shielded electric wire 3 is contained at a position surrounded by the shield shell 2. A terminal metal 4 is fixed to the end portion of the shielded wire 3, and in addition, a conductive ring 5, a rubber plug 6 and a rubber plug holder 7 are inserted so as to cover the shielded wire 3. A shield layer 3A is clamped between the conductive ring 5 and an underlying ring 8 which is integrally formed with the conductive ring 5. A backward end of the conductive ring 5 is connected to the shield shell 2, an electric wire insertion inlet 1A of the connector housing 1 is covered with the rubber plug 6, and the rubber plug 6 is further retained by the rubber plug holder 7 so as not to drop out.

However, in the shield connector according to the related art as described above, the rubber plug holder 7 has been provided on purpose for retaining the rubber plug 6 so as not to drop out, and therefore, components have increased in number and assembling work has been annoying.

By the way, there have been some shield connectors in which the shield layer 3A is folded back over an outer coating 9 of the shielded wire 3, and the conductive ring is fixed to the folded shield layer 3A. However, in such a shield connector according to the related art, because the underlying ring (not shown) has been simply in a cylindrical shape, the underlying ring must be also inserted over the shielded wire 3 from its distal end next to the rubber plug 6, and the assembling work has been much more annoying.

The present invention has been made in view of the above described circumstances, and it is an object of the invention to provide a shield connector which is excellent in assembling ability as compared with the shield connector according to the related art.

SUMMARY OF THE INVENTION

In order to attain the above described object, there is provided according to a first aspect of the invention, a shield connector comprising:

a connector housing adapted to accommodate a distal end portion of a shielded electric wire provided with a metal terminal so as not to drop out;

a shield shell adapted to cover the metal terminal;

a connecting member adapted to electrically connect the shield shell to a shield layer of the shielded electric wire which is exposed from an outer coating of the shielded electric wire;

a rubber plug which is fitted to an intermediate portion of the shielded electric wire to close a wire insertion inlet formed in the connector housing through which the shielded electric wire is inserted; and an underlying member formed of a metal plate curved in a U-shape, caulked and fixed to the outer coating of the shielded electric wire in a state where the outer coating is disposed inside the underlying member, wherein the shield layer is folded back over the outer coating to dispose the underlying member between the shield layer and the outer coating so as to clamp the shield layer between the underlying member and the connecting member.

According to a second aspect of the invention, there is provided A shield connector comprising:

a connector housing adapted to accommodate a distal end portion of a shielded electric wire provided with a metal terminal so as not to drop out;

a shield shell adapted to cover the terminal metal;

a connecting member adapted to electrically connect the shield shell to a shield layer of the shielded electric wire which is exposed from an outer coating of the shielded electric wire;

a rubber plug which is fitted to an intermediate portion of the shielded electric wire to close a wire insertion inlet formed in the connector housing through which the shielded electric wire is inserted; and an underlying member having a first and second barrel portions formed of metal plate curved in a U-shape and is continuously formed along the shielded electric wire, wherein the rubber plug has a small diametered portion extending from an end face of the rubber plug toward the underlying member;

the shield layer is folded back over the outer coating to dispose an underlying member between the shield layer and the outer coating so as to clamp the shield layer between the underlying member and the connecting member;

the first barrel portion is caulked and fixed to the outer coating, covered with the shield layer on the outside of the first barrel, and provided with the connecting member from the outside thereof, the second barrel portion is caulked and fixed to the small diametered portion of the rubber plug.

According to a third aspect of the invention, there is provided the shield connector according to any one of the first and second aspects of the invention, wherein the underlying member is formed with a locking projection projecting toward the outer coating of the shielded wire.

In the structure of the first aspect of the invention, because the underlying member has such a structure that the metal plate is curved in a U-shape, the underlying member can be attached to the shielded wire from a lateral side. Therefore, assembling ability of the underlying member increases as compared with the underlying ring, according to the related art, which has been in a cylindrical shape. Further, there will be no fear that the underlying member may move during assembling, since the underlying member has been fixed to the shielded wire by caulking.

In the shield connector according to the invention, the underlying member is fixed to the shielded wire by caulking the first barrel portion, and the rubber plug is fixed to the underlying member by caulking the second barrel portion to the small diametered portion of the rubber plug. As a result, the rubber plug is made immovable with respect to the shielded wire, and prevented from dropping out from the wire insertion inlet. With this structure, the rubber plug holder which has been conventionally required is unnecessary to attain reduction of the components in number, and the assembling workability is improved.

Because the underlying member is formed with the locking projection which projects so as to bite the outer coating of the shielded wire, the underlying member can be more reliably fixed to the shielded wire.

DETAILED DESCRIPTION OF PREFERRED EMBODIMENT

Figure 1:
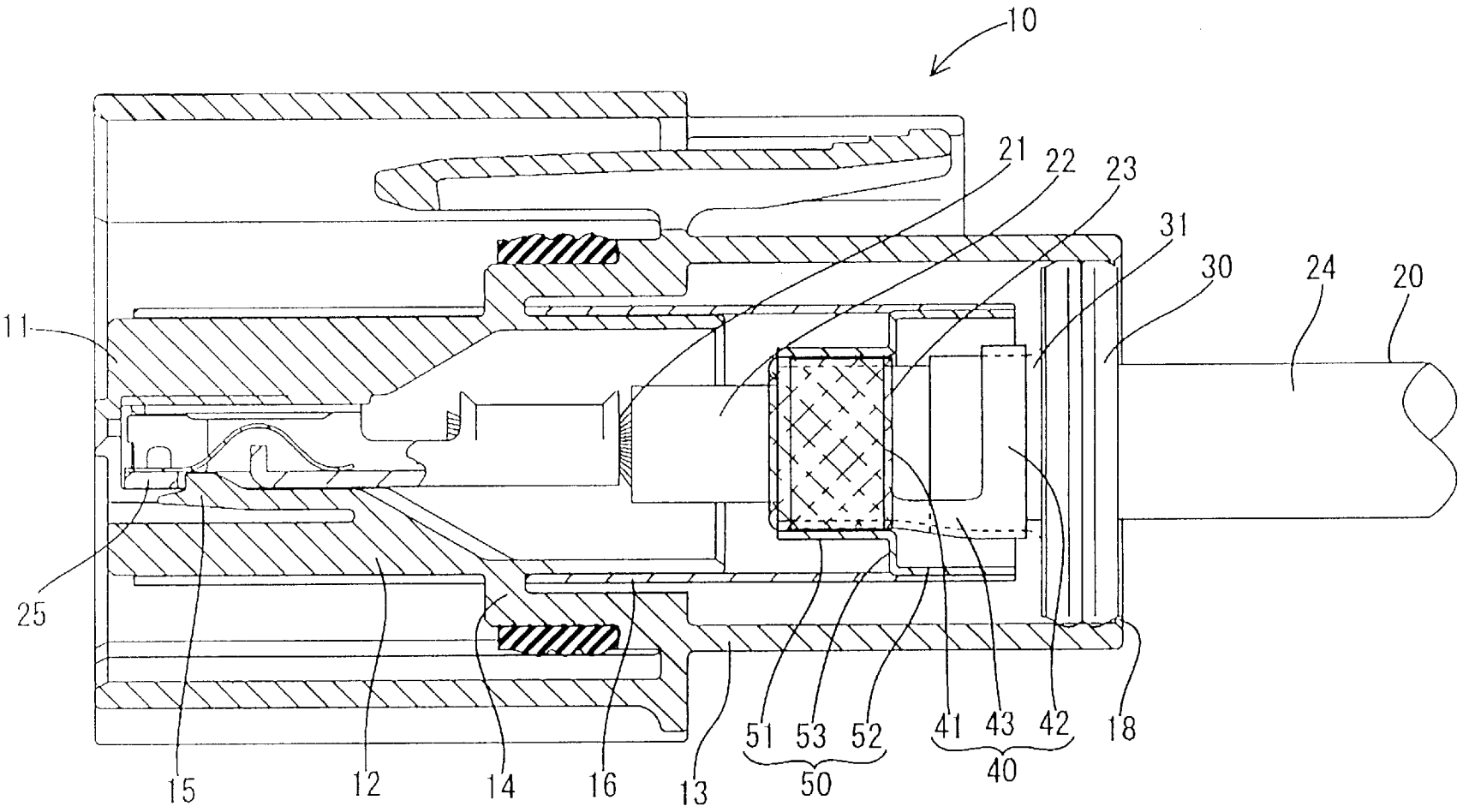
FIG. 1 is a sectional side view of a shield connector according to an embodiment of the invention.

Now, an embodiment according to the present invention will be described referring to FIGS. 1 to 4.

A connector housing 10 provided in a shield connector in the present embodiment (hereinafter referred to simply as "a housing 10") has a containing part 11 in a cylindrical shape. The containing part 11 has a forward cylindrical part 12 and a backward cylindrical part 13 arranged in an axial direction. Respective one ends of the forward cylindrical part 12 and the backward cylindrical part 13 are overlapped in a radial direction and connected by connecting walls 14 at a plurality of positions in a circumferential direction. A shield shell 16 formed of a metal plate curved in a cylindrical shape is inserted and assembled into a gap between both the forward and the backward cylindrical parts 12, 13.

Figure 4:
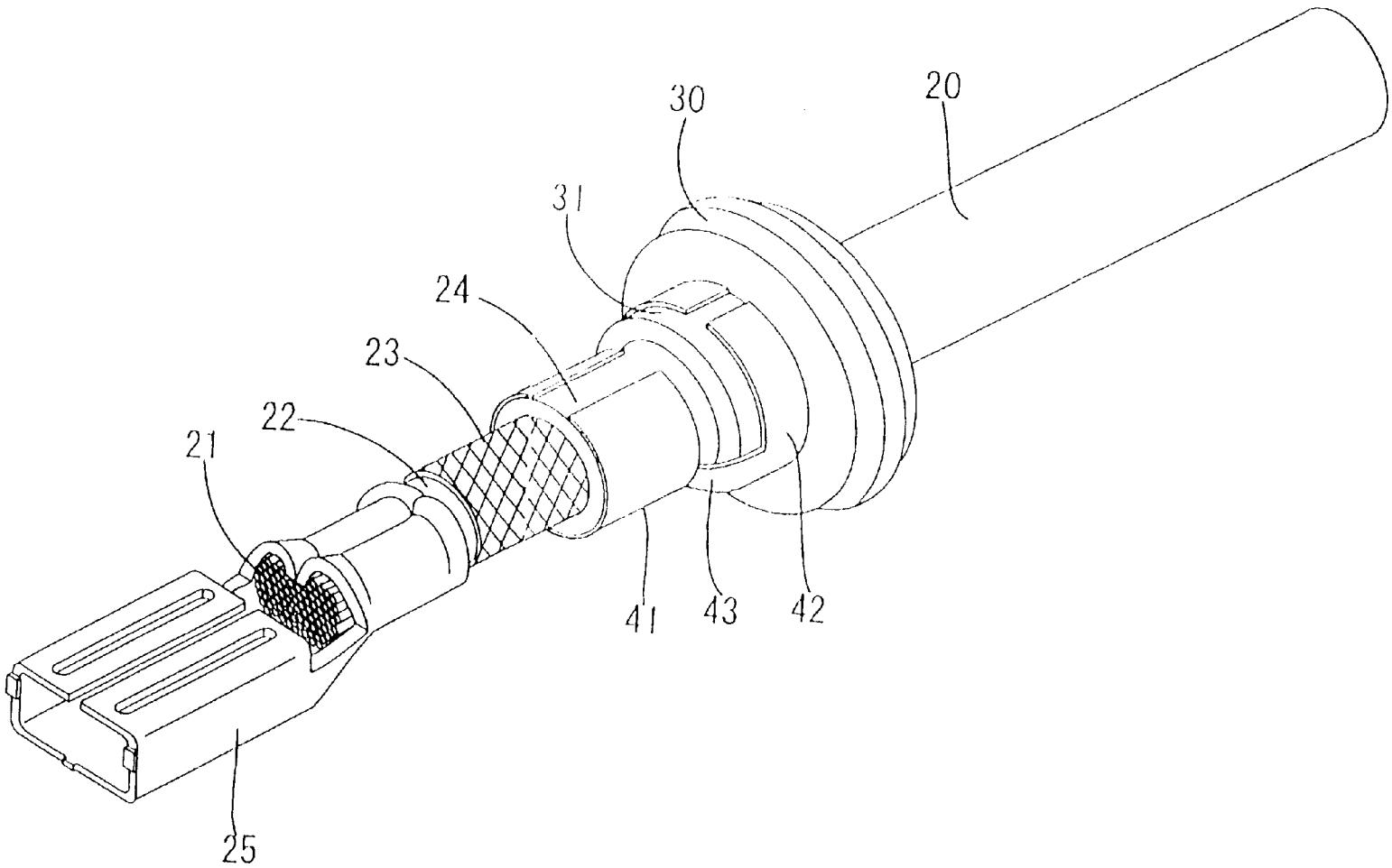
FIG. 4 is a perspective view of a shielded wire with a rubber plug locked by the underlying member.
Figure 5:
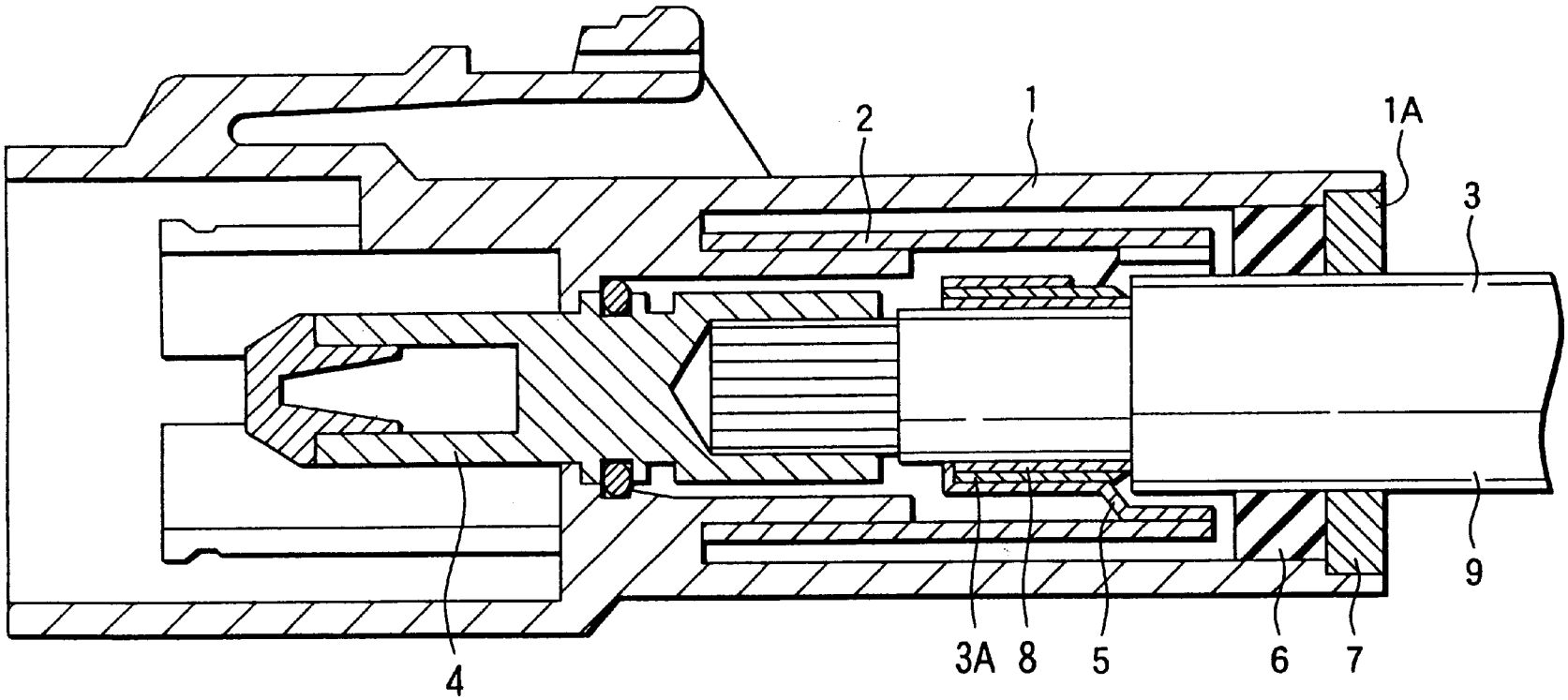
FIG.5 PRIOR ART
FIG. 5 is a sectional side view of a conventional shield connector.

A shielded electric wire 20, to which this shield connector is fitted, has a core wire 21, an inner insulating layer 22 covering the core wire 21, a shield layer 23 braided with fine metal wires and lying outside the inner insulating layer 22, and an outer coating 24 lying at the outermost side. As shown in FIG. 4, the core wire 21, the inner insulating layer 22 and the shield layer 23 are exposed from the outer coating 24 in order from its distal end. As shown in FIG. 1, a terminal metal 25 is pressure fitted to the core wire 21 and inserted into the containing part 11. The shielded wire 20 is retained in the containing part 11 through a lock with a terminal locking mechanism (a lance 15, specifically) which is provided in a depth of the containing part 11 and the terminal metal 25.

Over an intermediate portion of the outer coating 24 of the shielded wire 20, is inserted a rubber plug 30. The rubber plug 30 is in a cylindrical shape and in tight contact with both the outer coating 24 of the shielded wire 20 and an inner face of the housing 10. There is provided a small diametered portion 31 having a smaller diameter than an entire body of the rubber plug 30 extending from a forward end face of the rubber plug 30.

Figure 2:
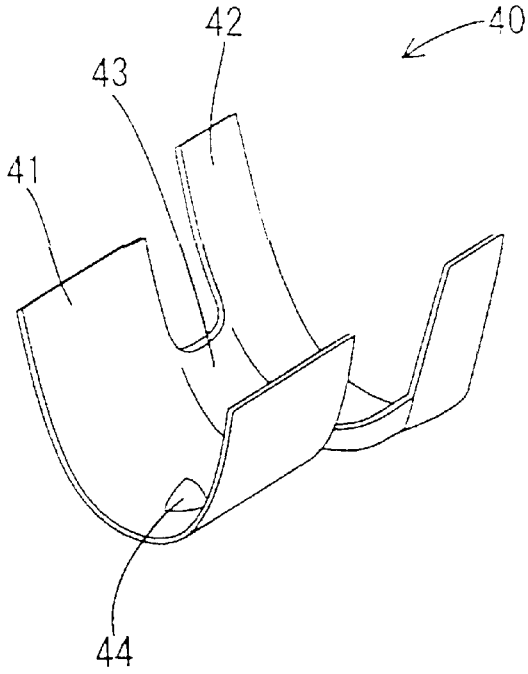
FIG. 2 is a perspective view of an underlying member.
Figure 3:
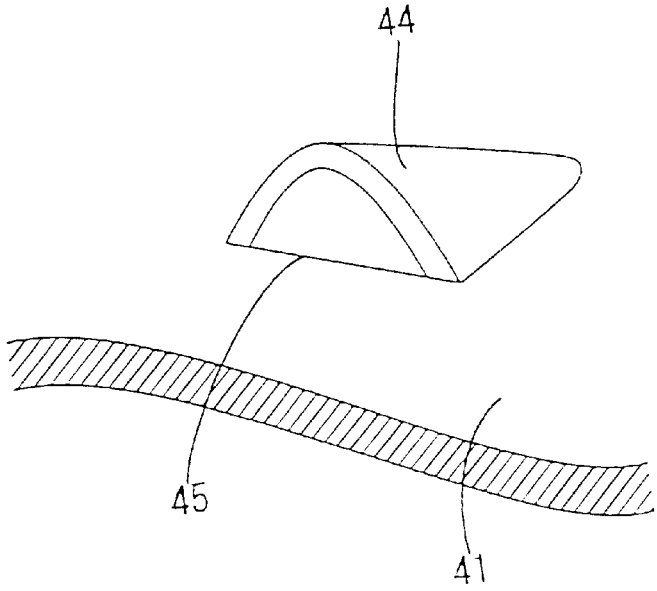
FIG. 3 is an enlarged perspective view of a locking projection.

On the outer coating 24 of the shielded wire 20, is mounted an underlying member 40. As shown in FIG. 2 in a state before the underlying member is mounted on the shielded wire 20, the underlying member 40 has a first and a second barrel portions 41, 42 formed of a metal plate curved in a U-shape, and connected by a connecting wall 42.

More particularly, the first barrel portion 41 is curved with a curvature corresponding to an outer diameter of the outer coating 24, and the second barrel portion 42 is curved with a curvature corresponding to an outer diameter of the small diametered portion 31 of the rubber plug 30. A locking projection 44 is formed in a bottom of the first barrel portion 41 by cutting out. As shown enlarged in FIG. 3, the locking projection 44 is constructed in such a manner that a rectilinear cut out 45 is formed in the metal plate which constitutes the first barrel portion 41 in a direction intersecting an axial direction of the shielded wire 20, and a forward side of the metal plate (a side of the cut out 45 remote from the second barrel portion 42) is stamped out to project toward the shielded wire 20.

An electrically conductive sleeve 50 is mounted around the first barrel portion 41 as shown in FIG. 1 so as to clamp the shield layer 23 between the electrically conductive sleeve 50 and the first barrel portion 41. The electrically conductive sleeve 50 has a small cylindrical part 51 and a large cylindrical part 52 interconnected at their respective one ends by a disc wall 53. As shown in FIG. 1, the small cylindrical part 51 is engaged with an outer face of the first barrel portion 41 interposing the shield layer 23 therebetween, and the large cylindrical part 52 is engaged in the shield shell 16.

Now, operation of the shield connector in this embodiment will be described.

In order to assemble the shield connector, the rubber plug 30 is first inserted over the shielded wire 20, and the underlying member 40 is applied to the outer coating 24 of the shielded wire 20 from a lateral side. Positioning the distal end portion of the outer coating 24 in the first barrel portion 41, and positioning the small diametered portion 31 of the rubber plug 30 in the second barrel portion 42, the first and the second barrel portions 41, 42 are caulked by means of a tool which is not shown. With this operation, the first barrel portion 41 is pressed to the outer coating 24, and the locking projection 44 formed in the first barrel portion 41 bites the outer coating 24, whereby the underlying member 40 is reliably fixed to the shielded wire 20 so as not to move. Moreover, because the second barrel portion 42 is fixed to the rubber plug 30 by caulking, the rubber plug 30 and the underlying member 40 are fixed to each other, and in this manner, the rubber plug 30 is made immovable with respect to the shielded wire 20.

Then, the electrically conductive sleeve 50 is inserted over the shielded wire 20 from the distal end, and mounted in a state that the shield layer 23 is folded back to be interposed between the small diametered portion 51 of the electrically conductive sleeve 50 and the first barrel portion 41. The terminal metal 25 is pressure fitted to the core wire 21 of the shielded wire 20. When the terminal metal 25 is pushed into the containing part 11 through the wire insertion inlet 18 of the housing 10, the rubber plug 30 is brought into tight contact with an inner periphery of the wire insertion inlet 18 to attain waterproofing of the wire insertion inlet 18. On this occasion, in the depth of the containing part 11 in the back of the rubber plug 30, the large diametered portion 52 of the electrically conductive sleeve 50 is pushed into the shield shell 16 and brought into tight contact therewith. In this manner, the shield layer 23 and the shield shell 16 are electrically connected to each other by way of the electrically conductive sleeve 50. Moreover, in the deepest part of the containing part 11, the lance 15 comes into engagement with the terminal metal 25, and the shielded wire 20 is thus retained in the containing part 11 so as not to drop out.

By the way, when the shield connector according to this embodiment has been coupled to a mating connector and the containing part 11 has been sealed, an inner pressure increases inside the containing part 11, and the rubber plug 30 receives a force in such a direction that it is pushed out from the wire insertion inlet 18. However, in the present embodiment, the rubber plug 30 is retained by the second barrel portion 42 of the underlying member 40 which is fixed to the shielded wire 20, and locked so as not to move in the axial direction of the shielded wire 20. Accordingly, the rubber plug 30 will not drop out from the wire insertion inlet 18.

As described, in the shield connector according to this embodiment, since the rubber plug 30 is immovably fixed to the shielded wire 20 by means of the underlying member 40 and prevented from dropping out from the wire insertion inlet 18, the rubber plug holder which has been required in the shield connector according to the related art is unnecessary. Thus, the number of the components can be reduced and the assembling workability will be improved. Further, since the underlying member 40 has such a structure that the metal plate is curved in a U-shape, the underlying member 40 can be attached to the shielded wire 20 from the lateral side. Therefore, the underlying member 40 can attain better assembling ability as compared with the underlying ring according to the related art which has been simply in a cylindrical shape.

The present invention is not limited to the embodiment as herein described referring to the above description and the drawings, but various modifications can be made within a scope the gist of the invention. Although the underlying member in the described embodiment has the second barrel portion to be fixed to the rubber plug 30, the underlying member may of such a structure that the underlying member has only the barrel portion without providing the second barrel portion, and may not be fixed to the rubber plug.

What is claimed is:

1. A shield connector comprising:

a connector housing adapted to accommodate a distal end portion of a shielded electric wire provided with a metal terminal so as not to drop out;

a shield shell adapted to cover the metal terminal;

a connecting member adapted to electrically connect the shield shell to a shield layer of the shielded electric wire which is exposed from an outer coating of the shielded electric wire;

a rubber plug which is fitted to an intermediate portion of the shielded electric wire and is in tight contact with the connector housing so as to close a wire insertion inlet formed in the connector housing through which the shielded electric wire is inserted; and an underlying member formed of a metal plate curved in a U-shape, caulked and fixed to the outer coating of the shielded electric wire in a state where the outer coating is disposed inside the underlying member, wherein the shield layer is folded back over the outer coating to dispose the underlying member between the shield layer and the outer coating so as to clamp the shield layer between the underlying member and the connecting member.

2. The shield connector according to claim 1, wherein the underlying member is formed with a locking projection projecting toward the outer coating of the shielded wire.

3. A shield connector comprising:

a connector housing adapted to accommodate a distal end portion of a shielded electric wire provided with a metal terminal so as not to drop out;

a shield shell adapted to cover the terminal metal;

a connecting member adapted to electrically connect the shield shell to a shield layer of the shielded electric wire which is exposed from an outer coating of the shielded electric wire;

a rubber plug which is fitted to an intermediate portion of the shielded electric wire to close a wire insertion inlet formed in the connector housing through which the shielded electric wire is inserted; and a underlying member having a first and second barrel portions formed of metal plate curved in a U-shape and is continuously formed along the shielded electric wire, wherein the rubber plug has a small diametered portion extending from an end face of the rubber plug toward the underlying member;

the shield layer is folded back over the outer coating to dispose an underlying member between the shield layer and the outer coating so as to clamp the shield layer between the underlying member and the connecting member;

the first barrel portion is caulked and fixed to the outer coating, covered with the shield layer on the outside of the first barrel, and provided with the connecting member from the outside thereof, the second barrel portion is caulked and fixed to the small diametered portion of the rubber plug.

4. The shield connector according to claim 3, wherein the underlying member is formed with a locking projection projecting toward the outer coating of the shielded wire.

5. A shield connector comprising:

a connector housing adapted to accommodate a distal end portion of a shielded electric wire provided with a metal terminal so as not to drop out;

a shield shell adapted to cover the metal terminal;

a connecting member adapted to electrically connect the shield shell to a shield layer of the shielded electric wire which is exposed from an outer coating of the shielded electric wire;

a rubber plug which is fitted to an intermediate portion of the shielded electric wire and located at an end of the connector housing to close a wire insertion inlet formed in the connector housing through which the shielded electric wire is inserted; and an underlying member formed of a metal plate curved in a U-shape, caulked and fixed to the outer coating of the shielded electric wire in a state where the outer coating is disposed inside the underlying member, wherein the shield layer is folded back over the outer coating to dispose the underlying member between the shield layer and the outer coating so as to clamp the shield layer between the underlying member and the connecting member.

* * * * *